US005297598A

United States Patent [19]

Rasmussen

[11] Patent Number: 5,297,598

[45] Date of Patent: Mar. 29, 1994

[54] COIN BAG HOLDING DEVICE FOR COIN HANDLING MACHINES

[75] Inventor: James M. Rasmussen, Chicago, Ill.

[73] Assignee: Cummins-Allison Corp., Mt. Prospect, Ill.

[21] Appl. No.: 946,754

[22] Filed: Sep. 17, 1992

[51] Int. Cl.[5] ..... B65B 67/04

[52] U.S. Cl. ..... 141/314; 248/99; 248/101; 383/22

[58] Field of Search ..... 248/95, 99, 101; 220/404; 383/6, 12, 13, 22; 141/314, 315, 316

[56] References Cited

U.S. PATENT DOCUMENTS

| | | | |
|---|---|---|---|
| 617,961 | 1/1899 | Johnson | 248/101 |
| 2,307,181 | 1/1943 | Young | 383/22 |
| 5,011,455 | 4/1991 | Rasmussen | 453/10 |
| 5,031,808 | 7/1991 | Dolenc | 248/95 |
| 5,123,873 | 6/1992 | Rasmussen | 453/10 |
| 5,141,443 | 8/1992 | Rasmussen | 453/10 |

FOREIGN PATENT DOCUMENTS

| | | | |
|---|---|---|---|
| 0065007 | 11/1946 | Denmark | 248/101 |

*Primary Examiner*—Richard K. Seidel
*Assistant Examiner*—Allan M. Schrock
*Attorney, Agent, or Firm*—Arnold, White & Durkee

[57] ABSTRACT

A bag holding device for coin bags which require periodic removal and replacement. The device comprises a tube with an open upper end which receives coins and an open lower portion which fits into the mouth of a coin bag. A support bracket receives the tube. The bracket forms an elongated track to support and guide the tube during a sliding movement between an advanced position where the tube receives coins and a retracted position where the tube is accessible for removal and replacement of the coin bag. A clamping device at the advanced position of the tube grips both the tube and a coin bag on the lower portion of the tube. This device holds the coin bag on the tube and holds the tube in an advanced position.

10 Claims, 3 Drawing Sheets

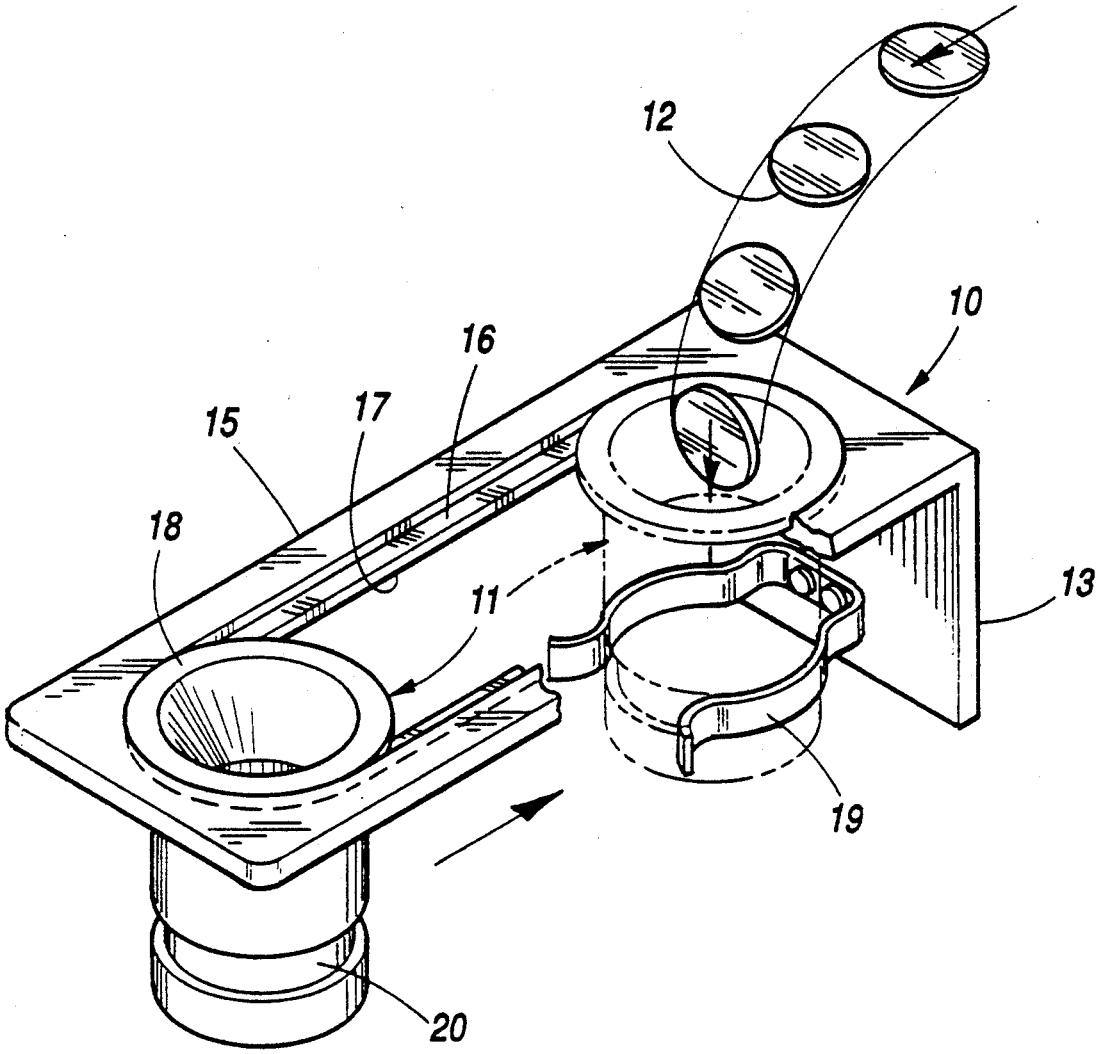
FIG. 1
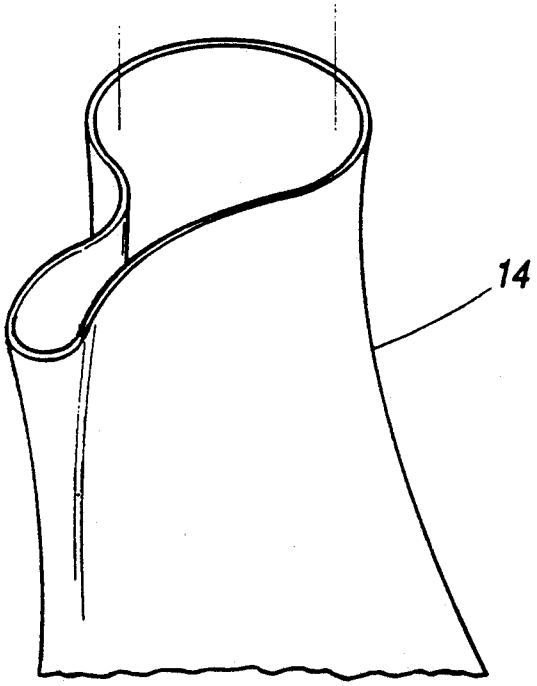

COIN BAG HOLDING DEVICE FOR COIN HANDLING MACHINES

FIELD OF THE INVENTION

The present invention relates generally to coin bag holding devices for use on coin sorters and other coin handling equipment which delivers large quantities of coins to one or more bags which must be frequently removed and replaced.

BACKGROUND OF THE INVENTION

There are many types of coin dispensing machines which deliver large quantities of coin at high speeds into awaiting containers. Coin sorting machines in particular, take mixtures of coins and separate them into individual streams of coins. Each of these coins, up to ten or more different sizes in some countries, has a container disposed beneath its exit location. The majority of these containers are cloth bags which are supported by some type of bag holding device.

There are several types of coin bag holding devices currently used on coin handling machines. Most of these devices include a hollow tube through which coins may flow into a bag, and a clamping member which holds the bag against, and around, the tube. One style utilizes a split ring which wraps around a tube having a tapered shape. The ring wedges the bag against the tube contour. Another style utilizes a pivoting (some are spring loaded) friction clamp located in front of the tube. The fold of the bag is manipulated between the clamp and its stop after the bag has been tightly wrapped around the tube.

While both of these devices are effective in supporting the coin bag, they are cumbersome in their use and require a great deal of visual access and manual dexterity in bag positioning and clamping operations. In many instances, the need to quickly remove and replace coin bags is impeded by the visibility and dexterity requirements of these devices. In addition, the inaccessibility of these devices on many machines adds to the inconvenience of their use as they are often located under and inward of the ideal operator access. These bag holding devices are also required to have sufficient hand clearance around each tube so that regardless of the operator's hand size, the operator is protected from injury during the installation and removal of bags.

SUMMARY OF THE INVENTION

It is a primary object of the present invention to provide an improved coin bag holding device which facilitates removal and replacement of the bags. In this connection, a related object of the invention is to provide such an improved coin bag holding device which minimizes the amount of visual contact required to remove and replace the bags, and in which the bag is readily accessible to the operator.

It is another important object of this invention to provide an improved coin bag holding device which permits the entire bag removal and replacement operations to be carried out by feel and, if desired, with the use of only one hand.

A further object of this invention is to provide an improved coin bag holding device which avoids the need for hand clearance between adjacent coin-discharge stations, thereby enabling multiple bag holding devices to be located in close proximity to each other so as to permit the size of the coin handling machine to be reduced.

Still another object of this invention is to provide an improved coin bag holding device which can be efficiently and economically manufactured from a small number of parts.

Other objects and advantages of the invention will be apparent from the following detailed description and the accompanying drawings.

In accordance with the present invention, the foregoing objectives are realized by providing a bag holding device comprising a tube having an open upper end for receiving coins and an open lower portion adapted to fit into the mouth of a coin bag, a support bracket for receiving the tube and forming an elongated track to support and guide the tube for sliding movement between an advanced position where the tube receives coins and a retracted position where the tube is accessible for removal and replacement of the coin bag, and a clamping device at the advanced position of the tube for gripping both the tube and a coin bag on the lower portion of the tube to hold the coin bag on the tube and to hold the tube in the advanced position.

In a preferred embodiment of the invention, the clamping device is a generally U-shaped stationary spring for receiving the tube in a bag surrounding the lower portion of the tube; the spring presses the bag inwardly against opposite sides of the tube, and permits the tube and bag to be inserted into and removed from the spring by mere application of manual force.

BRIEF DESCRIPTION OF THE DRAWINGS

FIG. 1 is a perspective view of a coin bag holding device embodying the present invention, and illustrating the feed tube in an advanced position where it receives a stream of coins and a retracted position where the bag can be conveniently removed from the tube;

DETAILED DESCRIPTION OF PREFERRED EMBODIMENTS

Figure 2:
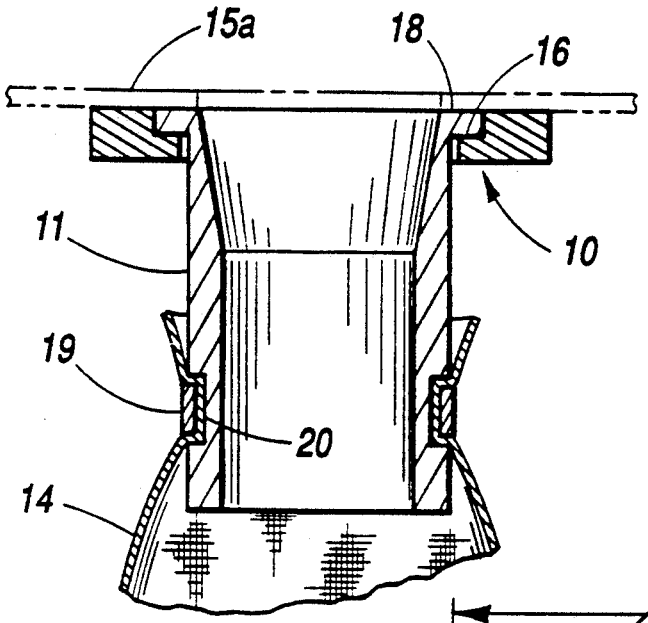
FIG. 2 is an enlarged vertical section taken through the bag holding device of FIG. 1 with the feed tube in the advanced position.

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents and alternatives falling within the spirit and scope of the invention as defined by the appended claims.

Turning now to the drawings and referring first to FIG. 1, there is shown a bag holding device which includes a bracket 10 supporting a feed tube 11 for receiving coins 12 from a coin sorter or other handling machine. In the case of a coin sorter, for example, six or more of these bag holding devices are mounted on the main housing of the machine for receiving the six or more different denominations of coins sorted by the machine. The vertical leg 13 of the bracket 10 is used to fasten the bracket to the machine housing, typically by means of multiple bolts passed through holes (not shown) in the bracket. As the coins 12 pass downwardly through the feed tube 11, they are funneled into a fabric bag 14 looped around the depending lower portion of the tube 11.

To permit the feed tube 11 to be moved back and forth between an advanced position (illustrated in broken lines in FIG. 1) and a retracted position (illustrated in solid lines in FIG. 1), the cantilevered horizontal arm 15 of the bracket 10 forms an elongated track 16 for the feed tube 11. In the particular embodiment illustrated, the track 16 is formed by a recess which extends continuously around the edge of an elongated slot 17 in the arm 15. This recess 16 receives an outwardly extending flange 18 on the top of the feed tube 11 so that the tube can slide back and forth between opposite ends of the slot. The inboard end of the slot 17 defines the advanced position of the feed tube 11, which is the position where the feed tube receives coins 12 from an aligned discharge chute extending outwardly and downwardly from the outer periphery of the coin-sorting mechanism. The outboard end of the slot 17 defines the retracted position of the feed tube 11, which is the position where the coin bags 14 are removed from, and replaced on, the lower portion of the tube. If desired, a cover plate 15*a* (FIG. 2) may be attached to the top of the arm 15 to restrain vertical movement of the tube 11 during sliding movement thereof along the track 16.

In order to hold the feed tube 11 in the advanced position while it is receiving coins, and also to hold the bag 14 on the lower portion of the feed tube, both the lower portion of the tube 11 and the surrounding portion of the bag 14 are gripped by a horizontal spring clip 19 mounted on the vertical leg 13 of the bracket 10. The spring clip 19 is generally U-shaped, with the two free ends thereof bent outwardly away from each other to facilitate entry of the tube 11 into the clip. As the tube 11 is urged into the entry throat formed by the bent ends of the spring clip, the forces applied to the free ends of the spring clip via the feed tube 11 force the two arms of the spring clip away from each other, thereby allowing the feed tube to enter between the curved central portions of the spring clip arms. The resilience of the spring metal then presses the two arms of the spring inwardly against the opposite sidewalls of the tube 11, gripping the bag 14 firmly between the spring clip 19 and the rigid tube 11. (see FIG. 2)

To assist in holding the bag 14 on the feed tube 11 while the bag is being filled with coins, the lower portion of the feed tube forms a circumferential groove 20 having a vertical dimension slightly greater than that of the arms of the spring clip 19 (see FIG. 2). The spring clip 19 presses opposite sidewalls of the bag 14 tightly into the groove 20, thereby preventing the bag from slipping downwardly from between the tube 11 and the clip 19 as the bag becomes filled with coins.

Figure 3:
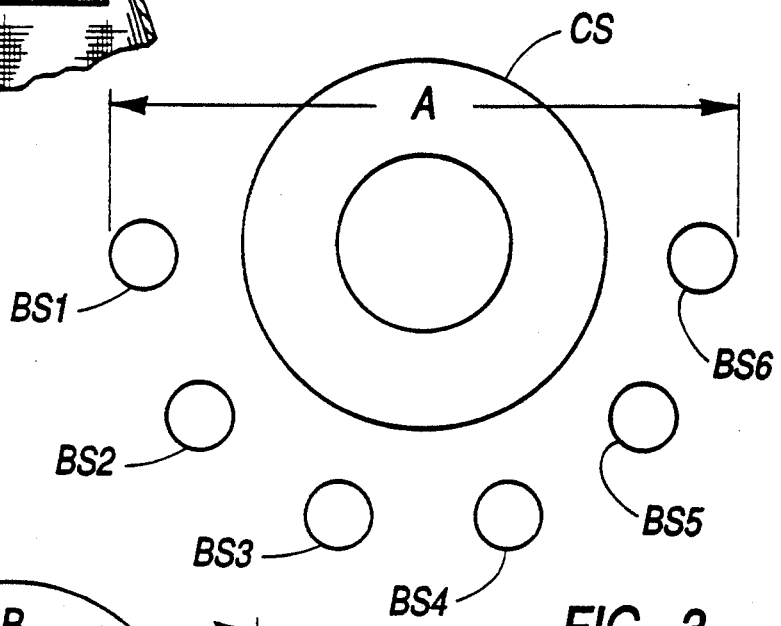
FIG. 3 is a diagrammatic illustration of an array of prior-art coin bag holding devices in a coin sorter.
Figure 4:
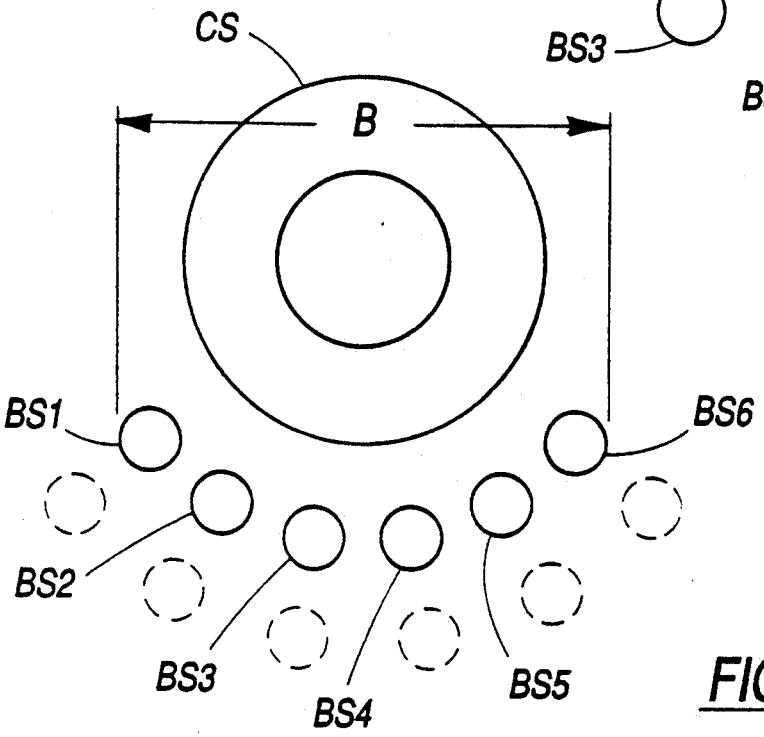
FIG. 4 is a diagrammatic illustration of an array of coin bag holding devices embodying the present invention in a coin sorter.

One of the advantages of the illustrative bag holding device is that it avoids the need for hand clearance between adjacent bag stations, as will be appreciated from the comparative diagrammatic illustrations in FIGS. 3 and 4. FIG. 3 illustrates a typical prior-art bag arrangement on a coin sorter CS which discharges six different denominations of coins at six bag stations BS1–BS6 spaced around the periphery of the front portion of the sorting mechanism. It can be seen that the six bag stations BS1–BS6 are spaced relatively far apart, to enable the operator to gain access to, and manipulate, the bag holding mechanism at each station without injury. This arrangement requires an overall dimension A between the outboard surfaces of the two diametrically opposed bag stations. FIG. 4 illustrates how the bag holding device of the present invention enables the bag stations BS1–BS6 to be located closer to each other, thereby reducing the overall outside dimension of the machine to B. This more compact arrangement of the bag stations is made possible by the fact that the bags can be moved outwardly away from the center of the sorting machine CS when it is desired to remove and replace a bag, as can be seen from the broken-line illustrations in FIG. 4. Moreover, there is no mechanism to be manipulated to release the bag.

When a bag becomes filled and needs to be replaced, the operator need only grip the loose flop of the coin bag on the outboard side of the tube 11 and pull it horizontally away from the spring clip 19. Manual force can easily overcome the clamping forces applied by the opposed arms of the spring clip 19. The operator simply pulls the bag and feed tube outwardly, holding the bag on the tube, until the tube is stopped by the outboard end of the slot 17, where the bag 14 can be easily removed by allowing it to slide downwardly off the feed tube. A new bag is then looped around the lower portion of the feed tube, and the tube and bag are pushed inwardly against the spring clip 19. Continued inward pressure against the spring clip forces the clip open and allows the feed tube and bag to enter the recessed central portion of the sprong clip, where the operator feels the feed tube snap into place as the arms of the spring clip snap back against the feed tube as it clears the entry throat of the clip. The operator then simply releases the tube and it is ready to receive coins from the sorting machine. This entire operation can be carried out with one hand, and an experienced operator can slide the feed back and forth without even making visual contact because of the mechanical limits provided for the feed tube at the opposite ends of its sliding track.

Figure 5:
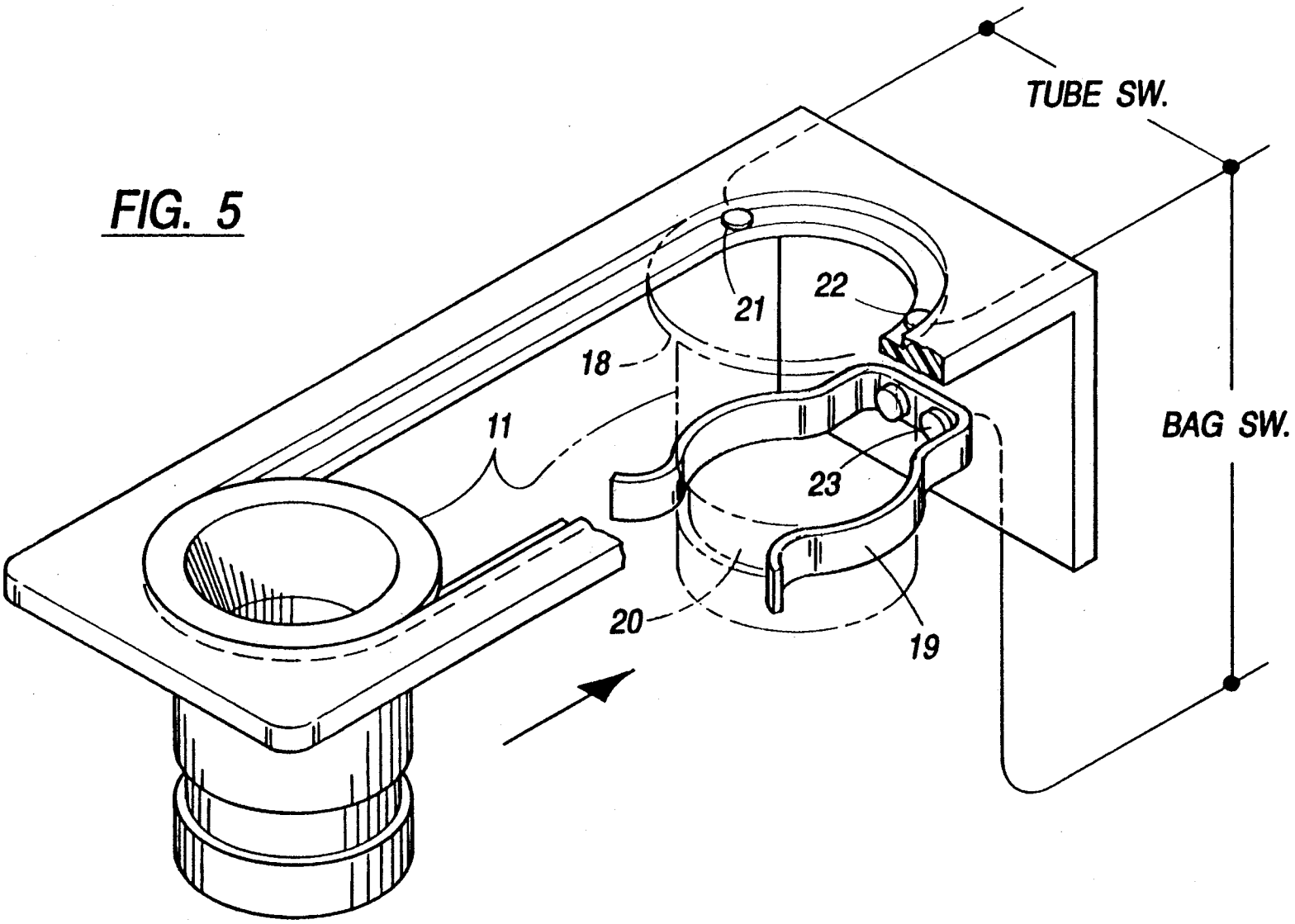
FIG. 5 is a perspective view of a modified form of coin bag holding device embodying the present invention and including two different electrical sensors.

As illustrated in FIG. 5, electrical contacts may be provided at the inboard end of the track 16 to provide an electrical signal which indicates the presence or absence of the feed tube 11 at its advanced position. In this particular arrangement, the bracket 10 is made of a non-conductive material, and a small electrical voltage is applied across the contacts 21 and 22. When the feed tube 11 is advanced to the inboard end of the track 16, the lower surface of the flange 18 engages the contacts 21 and 22, thereby closing the electrical circuit to provide a positive indication that the tube is present. A third contact 23 may be provided at the base of the spring clip 19, preferably through one of the mounting screws, to sense whether or not a bag is present on the tube 11 when the tube is held by the spring clip. When the tube 11 is enveloped by a fabric bag 14, the bag provides an insulating barrier between the contacts 22 and 23, thereby opening the circuit otherwise completed by the conductive metal tube 11 and the conductive metal spring clip 19. In the absence of a bag, the contact between the metal tube 11 and clip 19 forms a short circuit across the contacts 22 and 23 thereby closing the electrical circuit to provide a positive indication that the tube is present but without a bag.

I claim:

1. A bag holding device for coin bags which require periodic removal and replacement, said device comprising:

a tube having an open upper end for receiving coins and an open lower portion adapted to fit into the mouth of a coin bag, a support bracket for receiving said tube, said bracket forming an elongated horizontal track to support and guide said tube for sliding movement between an advanced position where the tube receives coins and a retracted position where the tube is accessible for removal and replacement of the coin bag, and a clamping device at the advanced position of said tube for gripping both the tube and a coin bag on the lower portion of the tube to hold the coin bag on the tube and to hold the tube in said advanced position.

2. The bag holding device of claim 1 wherein said support bracket includes a first end that forms said advanced position for said tube and a horizontal arm cantilevered from said first end.

3. The bag holding device of claim 1 wherein said clamping device comprises a generally U-shaped stationary spring clip for receiving said tube and a bag surrounding the lower portion of said tube, said tube having opposite sides and said spring pressing said bag inwardly against said opposite sides of said tube.

4. The bag holding device of claim 3 wherein the lower portion of said tube forms a circumferential groove in the outer surface thereof for receiving said spring clip.

5. The bag holding device of claim 3 wherein said U-shaped spring clip is positioned horizontally with the open end of the U facing the retracted position of said tube.

6. The bag holding device of claim 5 wherein the gripping force of said spring clip can be overcome by a manual pulling force on said tube.

7. The bag holding device of claim 1 which includes electrical contacts at said advanced position of said tube for detecting the presence or absence of said tube at said advanced position.

8. The bag holding device of claim 1 which includes electrical contacts at said advanced position for sensing the presence or absence of a coin bag on said tube when said tube is located at said advanced position.

9. A bag holding device for coin bags which require periodic removal and replacement, said device comprising:

a tube having an open upper end for receiving coins and an open lower portion adapted to fit into the mouth of a coin bag, a support bracket for receiving said tube, said bracket forming an elongated track to support and guide said tube for sliding movement between an advanced position where the tube receives coins and a retracted position where the tube is accessible for removal and replacement of the coin bag, a clamping device at the advanced position of said tube for gripping both the tube and a coin bag on the lower portion of the tube to hold the coin bag on the tube and to hold the tube in said advanced position, and said bracket includes a horizontal arm having an elongated slot formed therein to form said track, said tube extending outwardly through said slot and having a flange at the upper end thereof extending outwardly over opposite edges of the slot to support the tube on said horizontal arm.

10. The bag holding device of claim 9 wherein an upper surface of said horizontal arm is recessed around the periphery of said slot to receive said flange on said tube.

* * * * *